United States Patent [19]

Voecks

[11] Patent Number: 4,651,619

[45] Date of Patent: Mar. 24, 1987

[54] SHOTGUN SHELL DISPENSER FOR HAND RELOADING

[76] Inventor: Larry Voecks, 938 Via Mariposa, San Lorenzo, Calif. 94580

[21] Appl. No.: 801,194

[22] Filed: Nov. 25, 1985

[51] Int. Cl.[4] ..... F42B 33/00; F42B 5/26; B65H 5/04

[52] U.S. Cl. ..... 86/44; 86/45; 86/46; 221/151; 221/194; 221/209; 221/255; 221/256

[58] Field of Search ..... 86/44, 31, 23, 27, 46, 86/45, 38, 26; 10/162 R, 162 A, 165, DIG. 8; 221/152, 153, 155, 172, 191, 307, 194–196, 255–256, 258, 295, 151, 209; 206/3; 414/421

[56] References Cited

U.S. PATENT DOCUMENTS

| | | | |
|---|---|---|---|
| 918,606 | 4/1909 | Stillwell | 86/44 |
| 2,326,816 | 8/1943 | Woodberry | 86/45 |
| 2,356,806 | 8/1944 | Woodberry et al. | 86/45 |
| 2,402,097 | 6/1946 | Spraker | 86/46 |
| 2,453,736 | 11/1948 | Woodberry et al. | 209/72 |
| 2,795,323 | 6/1957 | Amundsen | 86/44 |
| 3,240,103 | 3/1966 | Lamont | 86/45 |
| 3,244,058 | 4/1966 | Hulterstrum | 86/44 |
| 3,813,987 | 6/1974 | Minneman | 86/44 |
| 3,893,557 | 7/1975 | Frenk | 86/45 |
| 4,261,680 | 4/1981 | Carnley et al. | 86/45 |
| 4,455,915 | 6/1984 | Ransom | 86/45 |

FOREIGN PATENT DOCUMENTS

| | | | |
|---|---|---|---|
| 1309796 | 1/1962 | France | 86/44 |

*Primary Examiner*—Stephen J. Lechert, Jr.
*Assistant Examiner*—Howard J. Locker
*Attorney, Agent, or Firm*—Bielen and Peterson

[57] ABSTRACT

A shotgun shell dispenser for efficient hand loading, the dispenser having a hopper into which a plurality of empty cases or hulls are oriented and stacked, a carousel reel for serial transport of casings from the hopper to a dispenser opening and a trip mechanism for releasing a single shell to a dispenser trough for convenient manual removal of the casing from the dispenser.

3 Claims, 4 Drawing Figures

SHOTGUN SHELL DISPENSER FOR HAND RELOADING

BACKGROUND OF THE INVENTION

This invention relates to a shotgun shell dispenser to enhance the efficiency of hand loading or reloading of empty cases or hulls by an ammunition enthusiast. It has become increasingly popular for shotgun users to self load their shells. Recovering spent cases and reloading with a desired charge and shot count saves approximately one-half the cost of ammunition and provides the self satisfaction of a uniform self-loaded shotshell. The desire for self loaded shells, particularly for high volume trap and sheet shooting has popularized the reloading of once discarded cases or hulls. While there are various types of equipment for efficient hand loading of shotshells including progressive reloaders with daisywheel carriages with automatic shot and charge dispensers, there are few devices for convenient and orderly supply of the cases to the reloader. Such devices customarily comprise stacking containers having an open side access for removal of the hulls.

Since the procedure for hand loading of spent hulls is repetitious, it is desirable to have a shotshell dispenser that continuously positions a case in precisely the same location, such that it can be grasped without altered motion and preferably without the operator having to visually remove his eyes from the packing stand when grasping the case from the casing storage container.

The shot gun shell dispenser of this invention has been devised to automatically position a shotshell case for convenient retrieval by an operator during the procedure of hand loading the case.

SUMMARY OF THE INVENTION

The shotgun shell dispenser of this invention comprises an aid to the self loader in hand loading either new or spent hulls with the necessary primer, charge, wad and shot for effective first use or reuse of the shell. Although commercially supplied shot shells are of such high consistency that improved accuracy is rarely achieved by self loading, there is a substantial savings which has increasingly popularized the reloading of spent cases or hulls, and, in many instances loading new hulls supplied by the ammunition manufacturers.

Shotshell loaders are generally lever operated press and dispensing apparatus that, depending on their sophistication, can load from 50 to 500 shells per hour. The loaders may be single stage, performing sequentially all operations on a single shell, or progressive, performing sequential operations in stages on multiple shells, usually six for the customery six steps in reloading.

To efficiently reload, even with the progressive reloaders, the materials must be readily and conveniently available. When spent hulls are collected or saved for reloading they must be sorted for size and type, since even the same size shell of different manufacturer may require a different charge, wad or shot count. Similarly, even the hull composition, paper or plastic, will determine the procedures employed, notably in crimping the ends of the loaded case. Damaged or worn cases are discarded and the useable cases arranged for reloading.

Since a substantial number of casings must be arranged for efficient processing, for example fifty or more at a stretch, it is desired that they be positioned for assembly-line style movement.

The shotshell dispenser of this invention comprises a hopper into which a plurality of cases are placed and uniformly oriented. The hopper feeds a revolving carousel in a housing that passes the shell cases past a trap opening. The trap opening dispenses a case to an access trough, which positions the shell case for easy grasping for transfer to the reloader mechanism. The trap opening remains closed so long as a shell case is seated in the dispenser trough.

The carousel continues feeding cases to the trough from the hopper until the hopper is exhausted of cases.

While the shell case dispenser was designed and sized primarily for shotshell cases, the design principles can be used for other shells and with appropriate change in size and arrangement to accommodate the differently sized and configured cartridges of single shot shells.

DETAILED DESCRIPTION OF THE PREFERRED EMBODIMENTS

Figure 1:
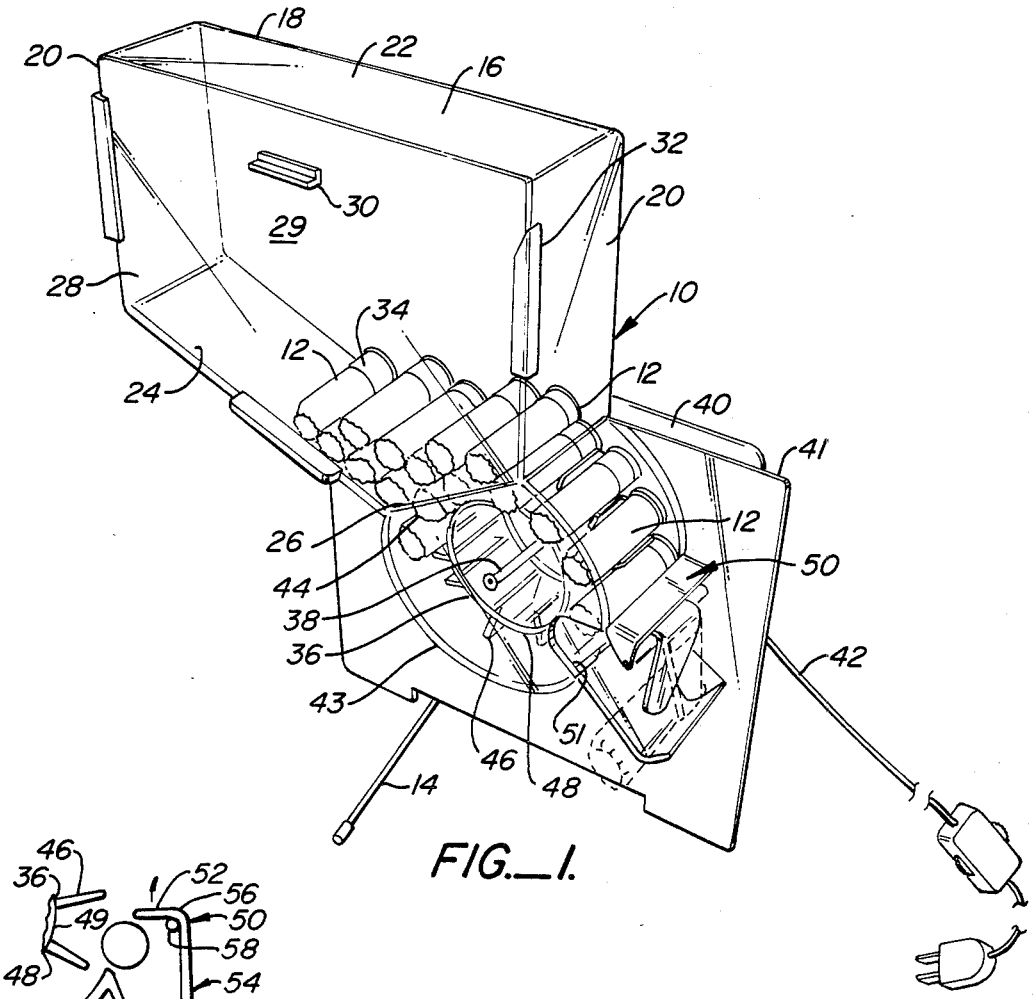
FIG. 1 is a perspective view of the shell case dispenser.

Referring to FIG. 1, the shotgun shell dispenser 10 of this invention is shown with a plurality of shotshell cases or hulls 12 to illustrate the manner of operation of the device. The shell dispenser 10 is primarily fabricated from a plastic, here a clear plastic, which is mounted on a wire leg tripod 14 for convenient counter top placement. The dispenser 10 is constructed with a large hopper 16 having a back wall 18, vertical sides 20, a top 22 and a sloped bottom 24 with a large corner opening 26. The front wall 28 comprises a removable panel 29 with a finger lift 30 for raising and removing the panel from guide slots 32. The hopper 16 can be sized to receive a desired quantity of shot shell cases, for example, from 50–100 cases, which is a convenient quantity to work with by adapt self loaders.

With the panel 29 removed, the hopper is stacked with presorted cases 12 oriented with the brass bases 34 directed against the back wall 18. The hopper is constructed such that the cases congregate for discharge at the corner opening 26, as the quantity of remaining cases diminishes.

Communicating with the corner opening 26 is a segment of a carousel reel 36. The carousel is rotatably mounted on a spindle 38 having a horizontal axis which is parallel to the orientation of the stacked cylindrical cases in the hopper. The spindle 38 is driven by a variable speed, low revolution electric motor 40 mounted on a back panel 41. The motor 40 is connected to a power source by a conventional cord 42. The reel 36 is confined within a housing comprising a cylindrical drum 43 having an upper quadrant opening 44 in common with the hopper opening 26 thereby allowing the cases contained by the hopper to freely pass to engagement with the carousel reel 36.

The carousel reel 36 is constructed with a plurality of evenly spaced vanes 46 radially projecting from a cylindrical core 48. The vanes are spaced to permit no more than a single shell case to fall into the receptacle 49 formed between adjacent vanes as shown in FIG. 1 and in the schematics of FIG. 3A and 3B. The shell cases 12 are carried around on the reel between the core 48 of the reel and the cylindrical drum 43 which retains the cases in the receptacles until they reach a trap mechanism 50 located at an opening 51 in a lower portion of the drum opposite the upper quadrant opening. The cases either are diverted by the trap mechanism 50 or continue rotating with the reel.

Figure 3A:
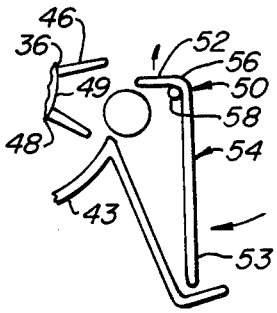
FIG. 3A is a schematic view of a trap mechanism in the discharge portion passing a shell case.
Figure 3B:
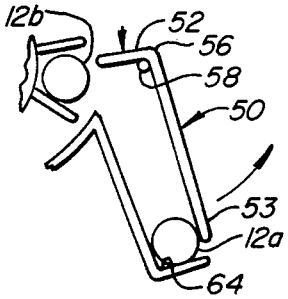
FIG. 3B is a schematic view of the trap mechanism blocking passage of a shell case.

Selectively blocking the opening 50 is a projecting tab portion 52 of a trap lever 54 oriented at a right angle to a pendant portion 53 of the trip lever 54. At the juncture 56 of the tab portion 52 and pendant portion 53 is a horizontal journal 58, pivotally mounted in a depending yoke 60 fixed to the drum 43 above the trap opening. The trap lever 54 also includes a weight plate 62 to insure that the pendant trip lever 54 is normally in a downward position as shown in FIG. 3A. In this position the blocking tab 52 is displaced from a blocking position allowing a case **12*a* interdentally disposed on the reel to pass the trap mechanism and drop to the dispensing trough 64 as shown in FIG. 3B. When the case 12*a* is positioned in the trough 64, the case displaces the trap lever 54 and hence the end tab 52, such that the end tab 52 blocks the drum opening 51 and prevents any succeeding case 12*b* from passing to the trough 64. Once the case is positioned in the trough 64** is removed, the trip lever moves to its natural pendant position permitting passage of another case through the opening to the trough.

Figure 2:
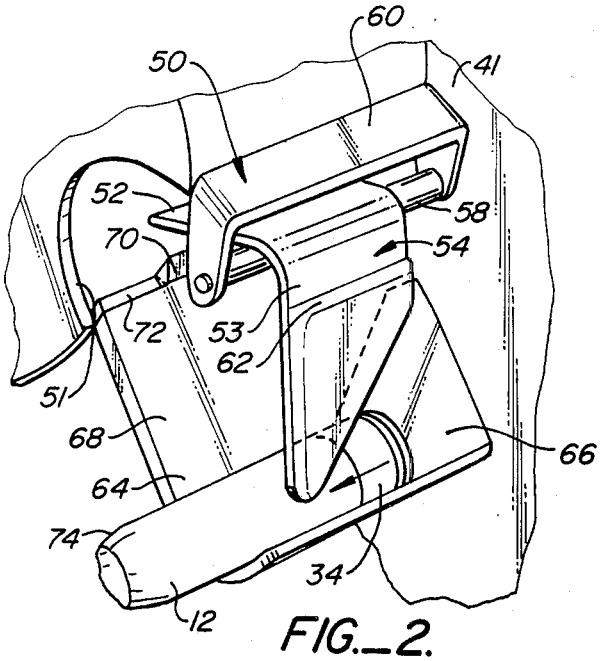
FIG. 2 is an enlarged partial view of the discharge portion of the dispenser of FIG. 1.

To enhance the convenience of removal of the dispensed case **12*a*, the trough includes an incline end wall 66 which contacts the brass shell base 34 and slides the shell forward as shown in FIG. 2. At the top of the slide wall 68 is a lip 70 having a notched end portion 72 such that the irregular crimped end 74 of the spent shot shell does not snag on the lip 70 and disorient the case as it descends to the trough 64**.

In operation, the reel continues to rotate and drop shells to the dispensing trough whenever the trough is vacant. If occupied the case lodged between the vanes simply continues to cycle until it is aligned with the trap opening at a time the trough is vacant.

While in the foregoing embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A shell dispenser for aiding the hand loading of empty ammunition shell cases by repeatedly positioning a single shell case on a dispensing support for convenient manual removal by a user during his hand loading operations, the dispenser comprising:

(a) a hopper having walls and a sloped bottom constructed to store a plurality of presorted cylindrical shell cases in a uniform stack with cylinder axes in a parallel orientation, the hopper having an opening at the sloped bottom for discharge of the shell cases;

(b) a rotatable carousel reel having a horizontal axis of rotation parallel to the cylinder axis of the stored cases in the hopper and perimeter with a plurality of discrete receptacles adapted to receive individual shell cases;

(c) a housing arranged about the reel to substantially contain the rotatable carousel reel and retain shell cases in the discrete receptacles, the housing having a casing dispensing support for positioning individual shell cases for manual removal from the dispenser, wherein the housing has a first upper opening communicating with the hopper wherein shell cases from the hopper pass by gravity to the receptacles, and, a second lower opening selectively communicating with the casing dispensing support for passing individual shell cases to the dispensing support from the discrete receptacles;

(d) trap means cooperatively arranged with the dispensing support and the lower opening of the housing for selectively blocking the lower opening when a casing is located on the dispensing support and automatically unblocking the lower opening when the casing on the support is manually removed by the user, and;

(e) drive means for continuously rotating the carousel reel to engage shell cases from the hopper into the discrete receptacles of the carousel.

2. The shell dispenser of claim 1 wherein the trap means comprises a pivotally disposed trip lever having a tab portion and a pendant portion, wherein the pendant portion is displaced by contact with a case positioned on the dispensing support, said tab portion blocking said second opening when said pendant portion is displaced.

3. The shell dispenser of claim 2 wherein said casing dispensing support comprises a trough having a sloped back wall for displacing a casing away from the back wall for convenient manual access.

* * * * *